United States Patent [19]

Bates

[11] 4,074,211

[45] Feb. 14, 1978

[54] DIELECTRIC SUBSTRATE FOR SLOW-WAVE STRUCTURE

[75] Inventor: Calvin Dwight Bates, Neptune, N.J.

[73] Assignee; The United States of America as represented by the Secretary of the Army, Washington, D.C.

[21] Appl. No.: 721,136

[22] Filed: Sept. 7, 1976

[51] Int. Cl.[2] ..... H01P 3/08; H01J 23/24; H01J 9/00

[52] U.S. Cl. ..... 333/31 R; 315/3.5; 333/84 R

[58] Field of Search ..... 333/31 R, 31 A, 84 R, 333/84 M, 31 C, 97 R; 29/600; 315/3.5, 3.6, 39.3, 39

[56] References Cited

U.S. PATENT DOCUMENTS

| | | | |
|---|---|---|---|
| 2,575,383 | 11/1951 | Field | 315/39 |
| 2,834,915 | 5/1958 | Dench | 333/31 A X |
| 2,882,441 | 4/1959 | Coulson | 333/31 A X |
| 2,932,760 | 4/1960 | Epsztein | 333/31 A X |
| 3,373,382 | 3/1968 | Diamand | 333/31 A |
| 3,594,665 | 7/1971 | Metcalf et al. | 333/31 R |
| 3,610,999 | 10/1971 | Falce et al. | 315/3.5 |
| 3,925,738 | 12/1975 | Bates et al. | 333/31 R |

*Primary Examiner*—Eli Lieberman
*Assistant Examiner*—Marvin Nussbaum
*Attorney, Agent, or Firm*—Nathan Edelberg; Sheldon Kanars; Edward Goldberg

[57] ABSTRACT

A ladder shaped dielectric substrate for a meander line slow-wave structure located between a serpentine metallic meander line conductor and a metallic ground plane. A pair of RF connectors having respective inner conductors connected to the ends of the meander line conductor are mounted on the ground plane.

10 Claims, 5 Drawing Figures

DIELECTRIC SUBSTRATE FOR SLOW-WAVE STRUCTURE

The invention described herein may be manufactured and used by or for the Government for governmental purposes without the payment of any royalties thereon or thereafter.

BACKGROUND OF THE INVENTION

This invention relates generally to microwave apparatus, and more particularly to a crossed field meander line slow-wave circuit device.

It has been determined in prior art crossed field meander line circuits, for example U.S. Pat. No. 3,904,994, entitled "Meander Line Circuit With An Interdigital Ground Plane", and U.S. Pat. No. 3,925,738, entitled "Rail or Pedestal Mounted Meander Line Circuit For Cross-Field Amplifiers", C.D. Bates, et al. that removal of the dielectric between meander line segments results in several advantages heretofore unavailable, namely, it eliminates the effects of sputtering which would otherwise act as a collection surface for sputtered metal, it eliminates extraneous RF dielectric loading of the RF wave formed by the meander line, and it reduces segment-to-segment capacitance of the metallic meander line which in turn reduces the dispersion and increases the bandwidth of the device. In the referenced patents there are shown meander line slow-wave circuit devices in which the dielectric support includes a raised surface portion which is shaped identically with the metallic conductor material disposed thereon.

SUMMARY

The subject invention is directed to an improvement in meander line slow-wave circuitry consisting of a metallic ground plane, a dielectric substrate contiguous with said ground plane, and a serpentine meander line conductor located on said dielectric substrate wherein the improvement comprises a substrate which is ladder shaped, having a plurality of regularly spaced transverse vane segments intersecting a pair of opposing longitudinal vane segments and upon which said meander line conductor is disposed whereupon certain portions of said vane segments are exposed while providing slot-like separations in the dielectric substrate between adjacent segments of the meander line conductor.

DESCRIPTION OF THE PREFERRED EMBODIMENT

Figure 1:
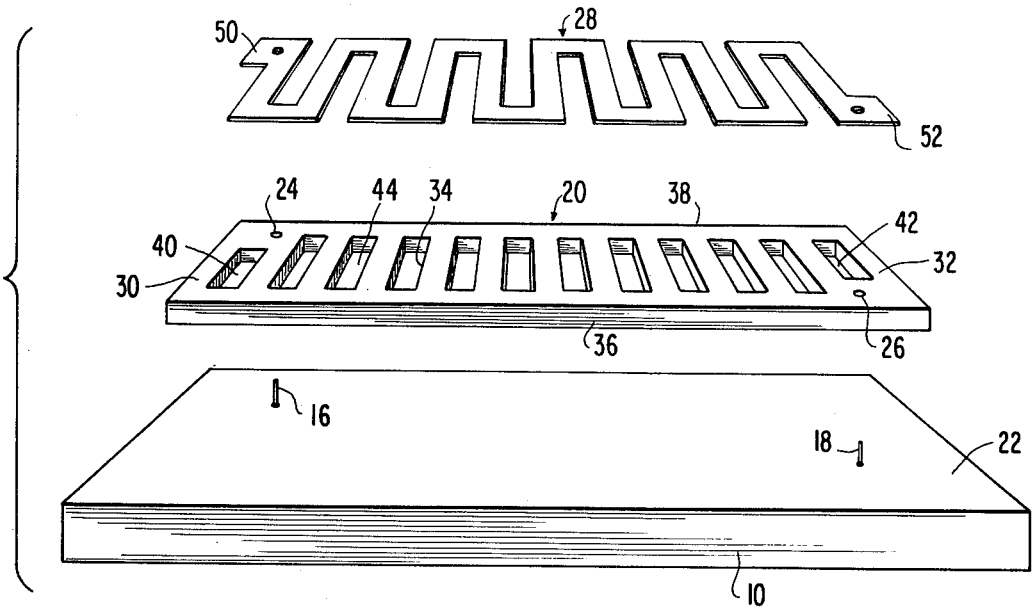
FIG. 1 is an exploded perspective view of a slow-wave circuit device including the preferred embodiment of the subject invention.
Figure 2:
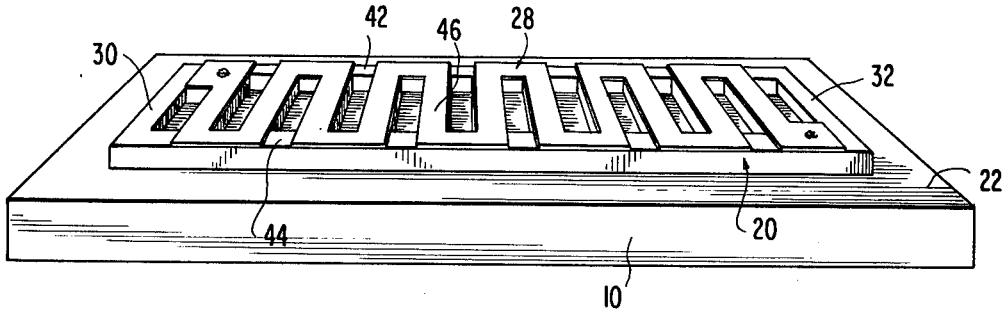
FIG. 2 is a perspective view of an assembled slow-wave device incorporating the subject invention.
Figure 3:
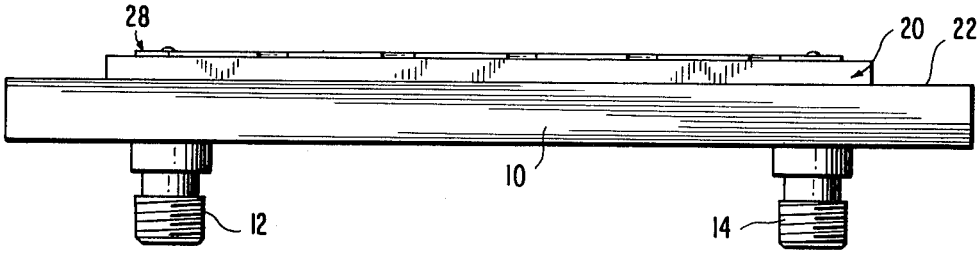
FIG. 3 is a front planar view of a slow-wave circuit device being further illustrative of the subject invention.

Referring now to FIGS. 1 through 3 collectively, wherein like numerals refer to like parts, reference numeral 10 denotes a metallic ground plane having a pair of RF connectors 12 and 14 (FIG. 3) mounted in opposite corner portions thereof and having respective inner conductor elements 16 and 18 projecting through but insulated from the ground plane shown in FIG. 1. A dielectric substrate 20, the shape of which comprises the subject invention, is contiguously placed against the upper surface 22 of the ground plane and includes a pair of through holes 24 and 26 (FIG. 1) in opposite corners for accommodating the passage of conductor elements 16 and 18 therethrough. The substrate 20 comprises a ladder shaped structure which is relatively easy to manufacture by well known laser cutting or other conventional fabrication techniques resulting in a more ruggedized form than heretofore available and one which is ideally suitable for handling during assembly of a complete slow-wave circuit device which also includes a metallic meander line conductor 28 disposed on the upper surface of the substrate 20.

The ladder shaped substrate 20 includes a plurality of transverse end and intermediate vane segments 30, 32 and 34 of equal surface width intersecting at right angles with a pair of parallel longitudinal vane segments 36 and 38 having a surface width dimension equal to or greater than that of the transverse vane segments, the latter being desirable if increased ruggedness is desired.

Figure 4:
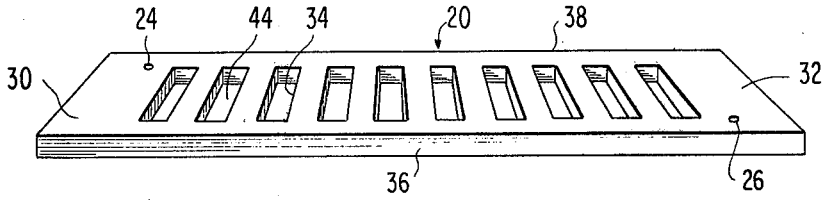
FIG. 4 is a perspective view of another embodiment of the subject invention.
Figure 5:
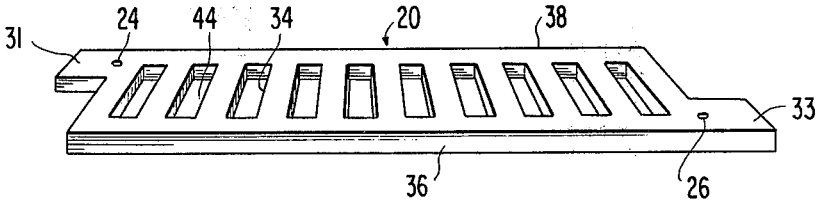
FIG. 5 is a perspective view of still another embodiment of the subject invention.

The structure thus formed includes but is not limited to a pair of mutually offset smaller sized end slots 40 and 42 located adjacent to the mutually diagonally located through holes 24 and 26 separated by a plurality of larger sized regularly spaced intermediate slots 44 which are situated between adjacent transverse line segments 46 of the meander line conductor 28. When desirable, for example, the end slots 40 and 42 can be eliminated leaving enlarged i.e. widened end segments 30 and 32 as shown in FIG. 4, or still the original end segments 30 and 32 shown in FIGS. 1 and 2 could be removed while leaving behind smaller end segments 31 and 33 as shown in FIG. 5 adjoining the through holes 24 and 26 so as to conform to the extremities of the meander line conductor to be described.

The meander line conductor 28 when configured as a square cornered serpentine structure having a surface width dimension substantially equal to the surface width dimension of the vane segments, overlies the intermediate transverse vane segments 34 as well as portions of the longitudinal vane segments 36 and 38 leaving exposed substrate portions 42 and 44 in the longitudinal vane segments 36 and 38, respectively, as well as the end transverse vane segments 30 and 32. The extremities 50 and 52 of the metallic meander line conductor 28 are adapted to be bonded to the conductor elements 16 and 18 shown in FIG. 1.

Thus what is provided is a dielectric substrate particularly suitable for a microwave device adapted for applications in apparatus such as crossed field amplifiers or oscillators, traveling wave tube amplifiers, solid state amplifiers and acoustic/surface wave devices.

Having thus disclosed by way of example but not of limitation what is at present considered to be the preferred embodiment of the subject invention, I claim:

1. In a meander line slow-wave circuit device consisting of a planar assembly including a conductive ground plane, a dielectric substrate contiguous with said ground plane and a serpentine meander line conductor having connecting transverse and longitudual segments disposed on a portion of the upper surface of said substrate, the improvement comprising:

an integral unitary ladder shaped planar dielectric substrate having a plurality of spaced transverse vane segments intersecting a pair of opposing continuous longitudinal vane segments, portions of said longitudinal vane segments between transverse vane segments being exposed when said meander line conductor is disposed thereon, and including a plurality of slot-like openings in the dielectric substrate between adjacent transverse segments of said conductor disposed on said transverse vane segments, the complete lower surface of said intersecting longitudinal and transverse vane segments of said substrate being in continuous direct contact with said ground plane.

2. The device as defined by claim 1 wherein said plurality of transverse vane segments are regularly spaced along the longitudinal vane segments.

3. The device as defined by claim 2 wherein said transverse vane segments have substantially equal surface width dimensions in the longitudinal direction thereby defining a plurality of like dimensioned slot-like openings.

4. The device as defined by claim 3 wherein said substrate includes end portions at opposite ends having respective through-holes therein, said conductor having corresponding ends with holes therein, and said ground plane having conductive elements extending through said holes in said substrate and conductor for connection to said conductor ends.

5. The device as defined by claim 4 wherein said through-holes are located in diagonal corner regions of said substrate end portions.

6. The device as defined by claim 5 wherein said end portions include respective end transverse vane segments having end slot-like openings adjacent said diagonal regions of relatively smaller transverse dimensions than the other said slot-like openings.

7. The device as defined by claim 5 wherein said end portions with said holes include respective end vane transverse segments of a relatively greater surface width in the longitudinal dimension than said regularly spaced intermediate transverse vane segments and having no slot-like openings in said end transverse segments of said substrate.

8. The device as defined by claim 1 wherein said longitudinal vane segments are mutually parallel and said transverse vane segments intersect said longitudinal vane segments at substantially right angles.

9. The device as defined by claim 1 wherein said substrate has a substantially uniform thickness.

10. The device as defined by claim 5 wherein said meander line conductor comprises a series of right angled interdigited conductor segments having a surface width dimension substantially equal to the respective surface width dimension of said transverse and longitudinal vane segments, said conductor ends having enlarged dimensions over said diagonal corner regions of said substrate.

* * * * *